United States Patent [19]

Osborne et al.

[11] 4,359,810

[45] Nov. 23, 1982

[54] METHOD OF FORMING CARTRIDGE CHAMBERS IN FIREARM BARRELS

[75] Inventors: William E. Osborne, Guilford; Arthur H. Burns, Jr., Hamden; James M. O'Keefe, Cheshire, all of Conn.

[73] Assignee: The Marlin Firearms Company, North Haven, Conn.

[21] Appl. No.: 112,558

[22] Filed: Jan. 16, 1980

[51] Int. Cl.[3] ..... B21J 13/08

[52] U.S. Cl. ..... 29/1.1; 72/370

[58] Field of Search ..... 29/1.1; 72/370

[56] References Cited

U.S. PATENT DOCUMENTS

| | | | |
|---|---|---|---|
| 41,669 | 2/1864 | Baker | 29/1.1 |
| 983,849 | 2/1911 | Wales | 72/370 X |
| 1,461,129 | 7/1923 | Loomis | 29/1.1 |
| 2,383,356 | 8/1945 | Walker | 29/1.1 |
| 2,464,323 | 3/1949 | Lee | 29/1.1 X |
| 2,663,410 | 12/1953 | Kessler | 29/1.1 X |
| 3,753,365 | 8/1973 | Kralowetz | 29/1.1 |

*Primary Examiner*—Horace M. Culver

*Attorney, Agent, or Firm*—Walter Spruegel

[57] ABSTRACT

Method of forming a cartridge chamber in the bore of a firearm barrel, which comprises driving into the bore of the barrel from the butt end thereof a mandrel of the surface configuration of the peripheral wall and mouth of the cartridge chamber, whereby the bore metal is squeezed into close form-fit with the mandrel, and then retracting the mandrel from the barrel bore.

8 Claims, 6 Drawing Figures

METHOD OF FORMING CARTRIDGE CHAMBERS IN FIREARM BARRELS

This invention relates to cartridge chambers in firearm barrels in general, and to a method of forming such cartridge chambers in particular.

The cartridge chambers in firearm barrels are customarily formed to meet fairly high precision standards for holding fed cartridges in accurate placement therein. To that end, the lengths of the bores in firearm barrels which are designated for cartridge chambers are customarily reamed to size and the mouths of the chambers at the butt ends of the barrels are shaped in characteristic fashion by chamfering, whereupon the reamed chamber walls are honed to a polished finish. While the formation of cartridge chambers in this fashion is satisfactory in most respects, it is also lacking in a few but important respects. Thus, the formation of cartridge chambers by successive reaming, chamfering and honing operations entails rather high cost not only due to the plural operations involved in the formation of each chamber, but also due to the nature of these operations especially with respect to reaming and honing the chamber walls which are fairly slow operations and require close attention by rather skilled operators. Also, reaming the peripheral walls of cartridge chambers to size, while particularly well suited for holding the chambers within the very close permissible tolerances of their specified diameter and also getting the chamber walls into fairly smooth condition for their subsequent honing to a polished finish, often requires repeat reaming operations in different chambers owing to the exceedingly small metal removal which is so characteristic of reaming, and so adds still further to the high cost of forming the cartridge chambers. Further, since it is very difficult to form the mouths of cartridge chambers in a rounded pattern that comes anywhere near the uniform curvature of the rims of thin-walled cartridge casings at their junction with the peripheral walls thereof, the formation of the mouths of the cartridge chambers by ready chamfering is much preferred to any malformed mouths with particularly objectionable ridge marks that would be the inevitable result of attempts at smoothly rounding them in production. Yet, forming the mouth of a cartridge chamber by chamfering leaves the same not only with a flat chamfer surface in contrast to the confronting curved surface of the drawn casing of a chambered cartridge, but also with a distinct corner edge at its junction with the peripheral chamber wall, of which both, the chamfer surface and corner edge, are quite objectionable for several reasons. Thus, cartridges at times become caught on the chamfer surface or corner edge at the mouth of a chamber in the course of their feed into the latter by semi-automatic or bolt action. Also, fed cartridges on their way to a chamber will at times be chafed by the corner edge at the chamber mouth, whereby projectiles thus chafed, and hence deformed, will on firing take an inaccurate course. Further, in forming cartridge chambers in rifled barrels, the reamer operated in sizing the chamber walls will at the rifling form burrs which are irremovable and adversely affect the accuracy of fired cartridges at least for some time until they are eventually blown out by powder gases.

It is a primary object of the present invention to form a cartridge chamber in the bore of a firearm barrel at the butt end thereof, not by removing any metal whatever, but solely by working the metal thereat in compression for its forced flow into particularly close form-fit with a mandrel of the exact surface configuration and flawless finish of the wall of the specified cartridge chamber, so that the metal of the barrel thus worked is truly reformed into a cartridge chamber. To this end, the mandrel is used like a punch for its forced entry into the bore of the barrel from the butt end thereof, with the mandrel being also formed with a tapered or rounded end for leading the mandrel into the barrel bore and also forming the customary throat at the transition of the chamber into the barrel bore. The formation of cartridge chambers in this "reform" fashion is vastly superior to, and entails none of the aforementioned deficiencies of, the previous formation of cartridge chambers by the multiple operations of reaming, chamfering and honing. Thus, forming a cartridge chamber in this featured reform fashion requires little, if any, skill on the part of an operator, and is accomplished quickly in any event and even instantaneously in a single stroke of the mandrel by mounting the same on the ram of a power press, wherefore the cost of thus forming a cartridge chamber is incomparably lower than heretofore. On the other hand, cartridge chambers thus formed are of high precision standard in that they have practically no variations in shape, size or surface finish and conform extremely closely to the surface configuration of the master pattern in the form of the mandrel as is inherent in working metal in compression against such a mandrel. Further, whereas in the previous formation of cartridge chambers with turning tools the chamber walls are left with tool marks which by nature tend more to oppose than not oppose smooth retraction of empty cartridge casings from the chambers, such marks as are left on the walls of cartridge chambers in the reorientation of the metal thereat in the course of their formation by the featured punch-like drive of a mandrel into the barrel bores have no tendency to oppose smooth retraction of empty cartridge casings from the chambers.

It is another important object of the present invention to form a cartridge chamber in the bore of a firearm barrel in the aforementioned reform fashion, which also includes reforming the metal at the butt end of the barrel into a smoothly rounded chamber mouth of a cross-sectional curvature of a radius which conforms fairly closely to the characteristic small radius of the curvature of the joint between the rims and peripheral walls of thin-walled drawn cartridge casings, whereby the mouth of cartridge chambers thus formed to a high precision standard are not only devoid of any surface deformities such as ridges or corners on which fed cartridges on their way to the chambers may become hung up or chafed, but they also contribute largely to invariably accurate placement of cartridges in the chambers. To the end of so reforming the metal at the butt end of a barrel into a neatly rounded chamber mouth, the mandrel is provided with an annular shoulder at a distance from its free end, and the junction between the shoulder and mandrel, being the mouth-forming base of the mandrel, is finished with the highest accuracy to the specified radius curvature, with the mouth of a cartridge chamber in a barrel being formed by the base of the mandrel simultaneously with the formation of the rest of the cartridge chamber on a single stroke of the mandrel into the barrel bore until the shoulder comes to rest on the butt end of the barrel.

It is a further object of the present invention to form a cartridge chamber, including its smoothly rounded mouth, in the bore of a firearm barrel, of which the wall of the chamber is as smooth as the peripheral wall of a previously formed chamber after its final honing to a polished finish, except that the smoothness of the wall of the reformed chamber extends to and includes the reformed mouth of the chamber. To this end, the mandrel to and including its mouth-forming base is of a very smooth and even polished surface finish which, in conjunction with the high operational friction between a barrel bore and the mandrel on its work stroke into the barrel bore, generates a uniformly polished surface finish on the wall, including the neatly rounded mouth, of the chamber. Cartridge chambers formed in this fashion are thus improved still further and quite significantly over previously formed chambers by the extent of the polished finish in unbroken continuity throughout their surfaces including their mouths. Also, in order to distribute somewhat more evenly over the mandrel the relatively high work load involved in reforming the metal in the bore wall of a barrel into a cartridge chamber and thereby contributing to a long useful life of the mandrel, the latter is preferably slightly tapered over its length in addition to its aforementioned more pronounced taper or rounded formation at its free end. Still further, even though the mandrel has a polished surface finish, it nevertheless will in its entry into a barrel bore with the necessary force to reform the metal thereat into a cartridge chamber encounter such high friction that lubrication of the mandrel is indicated to avoid seizure of the same in the barrel bore and consequent spoilage of the formed cartridge chamber on forced retraction of the mandrel from the barrel. Any suitable lubricant preferably in liquid form, such as oil, may thus be applied in the form of a drop or thereabout to the mandrel and barrel bore prior to entry of the former into the latter.

Further objects and advantages will appear to those skilled in the art from the following, considered in conjunction with the accompanying drawings.

In the accompanying drawings, in which certain modes of carrying out the present invention are shown for illustrative purposes:

Figures 1, 2, 3, 3A, 4, 5:
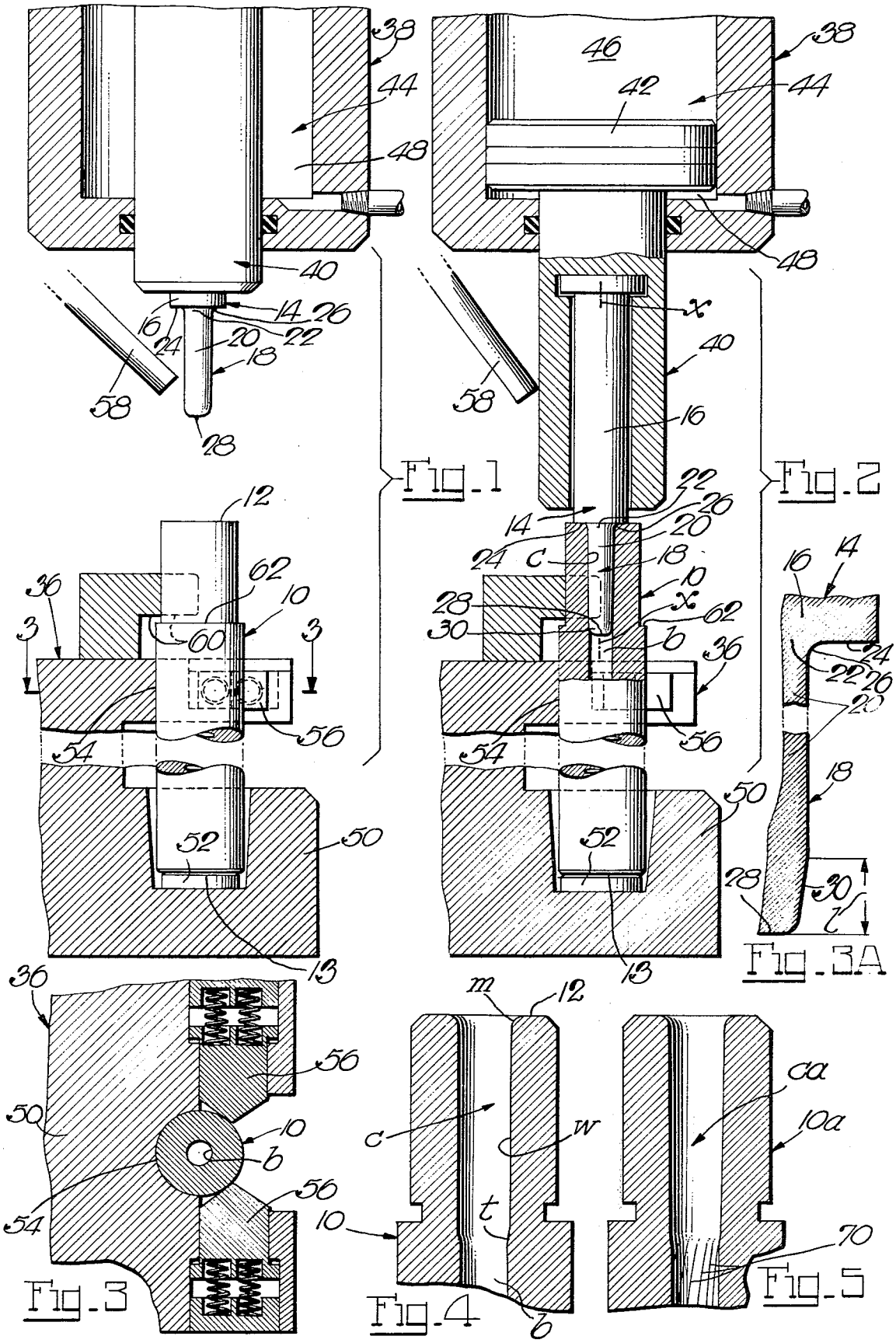
FIG. 1 is a fragmentary section through an installation in which to form in a firearm barrel a cartridge chamber in accordance with a featured method of the invention.
FIG. 2 is a fragmentary section through the same installation and showing a final stage in the formation of the cartridge chamber in accordance with the featured method of the invention.
FIG. 3 is a fragmentary section through the installation as taken on the line 3—3 of FIG. 1.
FIG. 3A is an enlarged fragmentary section through a prominent tool used in the formation of a cartridge chamber in the bore of a firearm barrel.
FIGS. 4 and 5 are enlarged fragmentary sections through a barrel with a cartridge chamber formed before and after rifling the barrel bore.

Referring to the drawings, and more particularly to FIGS. 1 to 3 thereof, there is shown an exemplary installation in which to form a cartridge chamber c in the bore b of a firearm barrel in accordance with a featured method of the invention. Such cartridge chambers, being of somewhat larger diameter than the barrel bores in which they are to be formed, are customarily formed by removing metal from the bores. The present invention contemplates the formation of cartridge chambers in barrel bores, not by removing metal therefrom, but rather by working the metal thereat in compression against a master pattern of the specified cartridge chamber in the form of a mandrel of the exact surface configuration of such cartridge chamber, with this mandrel being used like a punch for its forced entry into the bore of a barrel from the butt end thereof and resulting flow of the metal thereat into extremely close form-fit with the mandrel. The mandrel is in this instance formed as part of a punch 14 (FIGS. 2 and 3A), having a stem 16 with an axis x, and a projecting shank 18 which forms the mandrel. The part 20 of the mandrel which extends over the greater part of its length is cylindrical about the axis x and of a diameter equal to the specified diameter of the cartridge chamber, while a base part 22 of the mandrel 18 forms a junction between the cylindrical mandrel part 20 and a shoulder 24 on the stem 16, with this junction being of a cross-sectional curvature 26 that leads tangentially into the mandrel part 20 and into the shoulder 24 (FIG. 3A). The cross-sectional curvature of the base 22 of the mandrel is preferably and advantageously formed to conform rather closely to the cross-sectional curvature of the junction between the rims and peripheral walls of thin-walled drawn casings of cartridges of the caliber for which the cartridge chambers are adapted. Further, an endlength 1 of the mandrel to and including its free end 28 is tapered as at 30 and in this instance also rounded at its merger with the mandrel end 28 (FIG. 3A). The mandrel 18 thus formed has the exact surface configuration of the specified cartridge chamber, with the cylindrical part 20 of the mandrel having the surface configuration of the specified peripheral chamber wall, the base 22 of the mandrel having the surface configuration of the smoothly rounded chamber mouth, and the endlength 1 of the mandrel having the surface configuration and taper of the cartridge throat at the transition of the chamber wall into the bore wall.

For forming a cartridge chamber in the bore b of a barrel 10 in accordance with the featured method, the punch 14 is with its mandrel 18 forced into the barrel bore from the butt end 12 of the barrel until the shoulder 24 on the stem 16 comes to rest on the end of the barrel (FIG. 2), whereupon the punch is with its mandrel 18 retracted from the barrel bore. In thus forcing the mandrel 18 into the barrel bore b, the parts 20 and 22 of the mandrel form the peripheral wall w and the rounded mouth m of the cartridge chamber c, while the tapered end 30 of the mandrel, besides leading the mandrel into the barrel bore, also forms the throat t of the cartridge chamber (FIG. 4). In this connection, the tapered end 30 of the mandrel 18 is intermediate its length l of the diameter of the barrel bore b so that the throat t of the formed cartridge chamber c merges smoothly into the barrel bore b (FIG. 4).

The mandrel 18 of the punch is made to conform with the highest accuracy to the specification of the cartridge chamber, including its mouth and throat, and the exposed surface of the mandrel is of unbroken continuity throughout and is kept at a very smooth and polished finish. Thus, the very close conformity of a formed cartridge chamber to the surface configuration of the mandrel is due to the flow of the bore metal being worked in compression into form-fit with the mandrel on the forced pass of the latter into the barrel bore, while the polished surface finish of the mandrel together with the high friction between the bore metal and the mandrel on the forced pass of the latter into the barrel bore largely account for the rather close conformity of the surface finish of the formed cartridge chamber to the polished surface finish of the mandrel. Further, even though the mandrel has a smoothly polished surface finish, it nevertheless will, in its entry into a barrel bore with the necessary force to work the metal thereat in compression and into form-fit with the mandrel, encounter such high friction that lubrication of the mandrel and also barrel bore is indicated to avoid seizure of the mandrel in the barrel bore and also work-hardening of the latter. To this end, any suitable lubricant preferably in liquid form, such as oil or liquid wax, for example, may be applied to the mandrel and barrel bore just prior to forced entry of the former into the latter. Also, in order to distribute somewhat more evenly over the mandrel the relatively high work load involved in reforming the metal in the wall of a barrel bore into a cartridge chamber and thereby contribute to a long useful life of the mandrel, the latter is preferably slightly tapered over the length of its cylindrical part 20 in addition to the more pronounced taper of its end-length l.

As already mentioned, the formation of cartridge chambers in firearm barrels is preferably carried out with high efficiency in the installation shown in FIGS. 1 to 3, with the installation having as its major components a fixture 36 and a press 38 with a ram 40 which is preferably power-operated by a plunger 42 in a cylinder 44. The ram 40 carries the stem 16 of the punch 14 with some lateral play, and the punch is operated, on a down or work stroke by admitting operating fluid into the top end 46 of the cylinder 44 and venting the bottom end 48 thereof, and on its return stroke by admitting operating fluid into the bottom end 48 and venting the top end 46 of the cylinder, with the operating fluid being passed to and from the cylinder through a suitable valve (not shown) under the control of an operator. The fixture 36 has a base 50 with a bottom rest 52 and a top rest 54 for a barrel, with a barrel being placed into the fixture by an operator simply by standing the barrel with its muzzle end 13 on the bottom rest 52 and snapping the barrel near its upper end past spring-urged latch elements 56 into back-up against the top rest 54. For proper lubrication of the mandrel 18 and the bore of a barrel in the fixture 36 just prior to the formation of a cartridge chamber in the barrel by the mandrel, lubricant, such as oil, for example, is released from a supply by a suitably controlled metering device (not shown) and discharged through a spout 58 in the amount of a few drops against the lower end of the mandrel 18 (FIG. 1) with some of that oil dropping off the mandrel and into the aligned bore of the barrel. The operator then actuates the aforementioned control valve for a work stroke of the punch 14 and ensuing formation of a cartridge chamber in the barrel bore, whereby on the downstroke of the ram 40 the same cams the spout 58 out of the way (FIG. 2), with the spout being to this end suitably pivoted and normally urged into the operative position in FIG. 1. The lateral play of the stem 16 of the punch 14 in the ram 40 is advantageous in that the mandrel may on its work stroke yield sufficiently sideways to be safely guided into the bore of a barrel even if the same would for some reason be somewhat out of alignment with the mandrel. The formation of the cartridge chamber in the barrel is achieved virtually instantaneously, i.e., when the mandrel 18 reaches its lowermost position (FIG. 2). The operator then actuates the control valve for the return stroke of the ram 40 with the punch 14 and ensuing retraction of the mandrel 18 from the bore of the barrel. The mandrel 18 is retracted from the barrel bore in this instance by being stripped therefrom, with the fixture having to this end a stop 60 which overlies a shoulder 62 on the barrel and retains the latter in the fixture on the return stroke of the ram 40 and punch 14. With the cartridge chamber thus formed in the barrel bore and the ram 40 and punch 14 returned to their upper position (FIG. 1), the operator removes the barrel from the fixture 36 by simply removing the barrel from the top rest 54 and past the latch elements 56 to clear the same, followed by lifting the barrel from the bottom rest 52. Cartridge chambers may then be formed in other barrels by placing them into the fixture 36 and causing repeat work and return strokes of the punch 14 as will be readily understood.

Among chambers formed in barrels quite successfully with the featured method were chambers for 22 caliber cartridges in barrel bores reamed, as usual, to 0.219" diameter, with the mandrel used having a wall-forming part with a diameter of 0.229" at its front and a diameter of 0.232" at its rear, and the mouth-forming part of the mandrel being cross-sectionally curved at a radius of 0.015". Thus, in forming these exemplary chambers, the maximum displacement of metal, i.e., steel, in the bore wall radially thereof was one-half of 0.232" −0.219" or 0.0065" and actually somewhat less due to very slight spring-back of the chamber wall on retraction of the mandrel therefrom. Also formed successfully with the featured method were chambers for 22 caliber magnum cartridges, with the mandrel used therefor having a wall-forming part with a diameter of 0.243" at its front and a diameter of 0.244" at its rear, whereby the ensuing maximum displacement of metal in the bore wall radially thereof was one-half of 0.244" −0.219" or 0.0125" and actually somewhat less due to very light spring-back of the chamber wall on removal of the mandrel therefrom. Further formed successfully were chambers for 30 caliber cartridges in barrel bores of 0.300" diameter, with the mandrel used having a wall-forming part with a diameter of 0.340" at its front and a diameter of 0.360" at its rear, whereby the ensuing maximum displacement of metal in the bore wall radially thereof was one-half of 0.360" −0.300" or 0.030" and actually somewhat less again due to very slight spring-back of the chamber wall on removal of the mandrel therefrom. The featured method thus lends itself to the formation of chambers for cartridges of different calibers, though there are limits to how large such calibers may be, with these limits being imposed by the resistance of the metal of barrels to being worked into form-fit with mandrels. Thus, chambers that are to accommodate cartridges of progressively larger calibers must be of progressively larger diameters than those of the barrel bores in which the respective chambers are formed, yet there is a limit to diametrically enlarging barrel bores by working the metal thereat into form-fit with the mandrels on their forced entry into the bores. In this connection, it has been found that chambers may successfully be formed with the featured method for cartridges of any caliber at least up to 30 caliber. Further in this connection, chambers have been formed according to the featured method for 45 caliber cartridges, and while the formed chambers turned out satisfactory in every respect, their formation did cause slight outward bulging of the barrels at the chamber location which was considered objectionable and indicative that the present method does not lend itself to satisfactory formation of chambers for 45 caliber cartridges.

While in the described method the formation of the chamber mouth in smoothly rounded fashion and even in conformity with the rounded junction between the rims and peripheral walls of thin-walled drawn cartridge casings has been featured, it is, of course, fully within the purview of the present invention to form the mouth-forming parts of mandrels in chamfer configuration where the specification of cartridge chambers calls for chamfered mouth formations.

With a cartridge chamber having been formed in the bore b of the barrel 10 in accordance with the featured method (FIGS. 2 and 4), the barrel bore may then be rifled in conventional manner, whereby no burrs will be formed in the barrel. However, the bore of a barrel 10*a* (FIG. 5) may first be rifled as at 70 and the bore wall may subsequentially be formed into the cartridge chamber ca in accordance with the featured method, whereby again no burrs are formed in the absence of any metal cutting operation on the bore wall in the formation of the cartridge chamber.

What is claimed is:

1. Method of forming a cartridge chamber in the bore of a barrel with a punch having a shank with a free end, a shoulder surrounding said shank and spaced from said end, and a junction between said shank and shoulder, of which said shank is substantially cylindrical about an axis except for being tapered over an endlength to said end, said shoulder lies in a plane substantially normal to said axis, and said junction is of the specified cross-sectional shape of the mouth of the cartridge chamber, with said shank, and junction having a continuous and exposed polished surface throughout, and said shank being intermediate said tapered endlength thereof of a diameter equal to that of the barrel bore, said method comprising forcing the punch with its shank end leading into the bore of the barrel from the butt end thereof until said shoulder rests on the butt end of the barrel and then retracting the punch from the barrel through the butt end thereof, whereby the mouth and peripheral wall of the cartridge chamber are formed into precise form-fit with said punch over its forced contact with the barrel bore, and the polished surface of said shank and junction will, in conjunction with the operation friction between the barrel bore and the shank and junction therein, generate a continuous and uniformly polished surface finish on the mouth and peripheral wall of the cartridge chamber.

2. Method of claim 1, in which said junction is of a cross-sectional curvature leading tangentially into said shank and shoulder, whereby said mouth is of the same cross-sectional curvature as that of said junction and leads tangentially into said peripheral chamber wall.

3. Method of claim 2, in which said cross-sectional curvature of said junction conforms substantially to that of the joint between the rim and peripheral wall of a drawn cartridge casing, whereby said mouth is of substantially the same cross-sectional curvature as that of said joint between the rim and peripheral wall of the drawn cartridge casing.

4. Method of claim 1, which further comprises applying lubricant to the bore in the barrel at the butt end thereof and to the shank of the punch prior to its entry into the barrel bore.

5. Method of claim 1, in which said punch is carried by the ram of a power press for its work stroke into and return stroke from the bore of a barrel, and the barrel is backed with its muzzle end against a fixed rest for the formation of the cartridge chamber in the barrel bore on the work stroke of the punch.

6. Method of claim 5, which further comprises holding a shoulder on the barrel which faces toward the butt end thereof in confronting relation with a fixed stop during the return stroke of the punch whereby the barrel is stripped from the shank of the punch.

7. Method of claim 1, which further comprises rifling the barrel bore prior to the formation of the mouth and peripheral wall of the cartridge chamber by the punch.

8. Method of claim 1, which further comprises rifling the barrel bore following the formation of the mouth and peripheral wall of the cartridge chamber by the punch.

* * * * *